United States Patent [19]

Zonn

[11] 4,264,892

[45] Apr. 28, 1981

[54] ALARM DEVICE

[76] Inventor: Lincoln M. Zonn, 1171 NE. 90 St., Miami, Fla. 33138

[21] Appl. No.: 973,528

[22] Filed: Dec. 26, 1978

Related U.S. Application Data

[63] Continuation-in-part of Ser. No. 890,294, Mar. 27, 1978, abandoned.

[51] Int. Cl.[3] ..... G08B 19/00

[52] U.S. Cl. ..... 340/521; 340/541; 340/545; 340/546; 340/594

[58] Field of Search ..... 340/57, 63, 65, 521, 340/541, 545, 546, 571, 584, 586, 594

[56] References Cited

U.S. PATENT DOCUMENTS

| | | | |
|---|---|---|---|
| 1,305,190 | 5/1919 | Bobo | 340/546 |
| 3,171,109 | 2/1965 | Appel | 340/594 |
| 4,006,452 | 2/1977 | Giacino | 340/65 |

*Primary Examiner*—Alvin H. Waring

[57] ABSTRACT

An alarm device which includes a housing, batteries in the housing, conductors and a light source and an audio signal in parallel to one another and connected to the batteries and switch means between the light source and the audio signal, in series therewith, and normally opened, yet adapted to be closed by movement of the switch to cause, optionally, a light or an audio signal and, alternatively, an attachment for the housing to provide an alternative circuit with a switch in it which is activated by heat, or by closing to a normal position upon release under predetermined conditions to override the signal and to cause an audio signal to warn a person that an intruder has entered a room or that the heat within a given location exceeds a certain predetermined amount.

2 Claims, 8 Drawing Figures

ALARM DEVICE

This is a continuation-in-part of my copending patent application Ser. No. 890,294 filed Mar. 27, 1978, now abandoned.

FIELD OF THE INVENTION

This invention relates to alarm devices and, more particularly, to a personal alarm device which may, optionally, be provided with an attachment for use in a briefcase.

BACKGROUND OF THE INVENTION

In the past there have been numerous types of alarms which are useful by persons to give a sense of security and to scare away a threat in the form of a burglar or a mugger. It is also useful to have an alarm device which is not only adapted to be carried by a user but, at his option, to be installed, such as in a motel or hotel door, so that, if the door is opened by an unauthorized intruder, it will give an audible signal to scare the intruder away.

It is, accordingly, an object of this invention to provide an improved alarm device which includes a battery and a sound signal device with a normally opened switch means arranged to be closed at the option of the user to cause an audible signal or, alternatively, to include a normally closed switch which is spring-biased into an opened position and captivated between the door and the door jamb so that, when the door is opened, the spring-biased switch will close and sound an audio signal to warn a person in the room of an unauthorized intrusion.

It is also a general object of this invention to provide an improved alarm device of the type described more fully hereinafter and in accordance with the objects set forth above and the claims as specified hereinafter for the purposes specified and with the equivalent means for achieving the same.

Generally speaking this device is comprised of an alarm device which includes a flashlight for emergency use which is activated by a switch and a horn activated by the same switch upon movement in an opposite direction through a neutral position and which may optionally be utilized for emergency use when a person is walking alone or feels himself in danger and which, further, includes a spring clip which is normally opened and which is adapted to be inserted between the door and a jamb or a window, under packages, etc., so that, when there is an unexpected or unauthorized movement, such as when the door is opened by an intruder, the switch will close and this switch is provided in an attachment so that, when the switch is closed by such an unauthorized action, the alarm will sound, and, optionally, the device may include a heat sensitive metal strip in the line cord which will change contour when exposed to heat and will cause the contact to be made to sound the alarm when fire or extreme heat is present. Finally, a mercury switch which is of the type commercially available on the market can be plugged into the device and be of a normally open type so that if a movement takes place which is not authorized, the mercury will be disturbed, causing it to shift and closing the switch which will cause an alarm, which may be intermittent, to be sounded whenever contact is made.

In accordance with these and the foregoing objects, the instant invention will now be described with reference to the accompanying drawings, in which.

DESCRIPTION OF THE DRAWINGS:

FIG. 2 is a back view thereof with a main coverplate removed and with an alarm operating device attached thereto for use in hotels, motels and the like;

FIG. 4 is a schematic illustration of a modified form of the invention for use in a briefcase or the like;

DESCRIPTION OF THE PREFERRED EMBODIMENT

Figure 1:
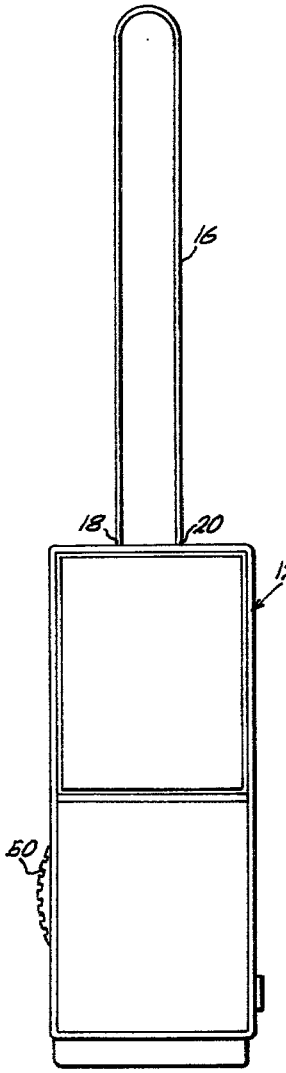
FIG. 1 is a front elevational view of the alarm device of the present invention.
Figure 2:
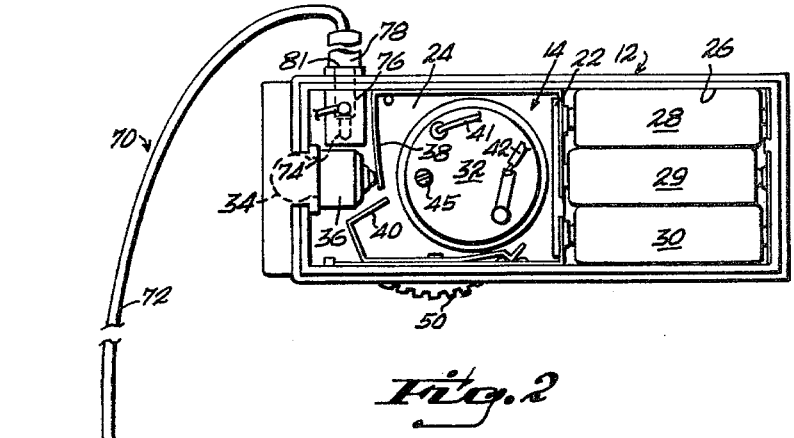
Figure 4:
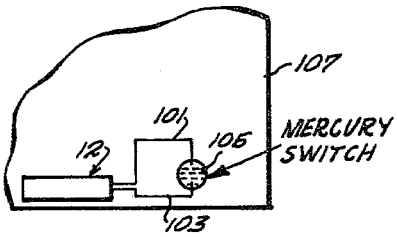
Figure 3:
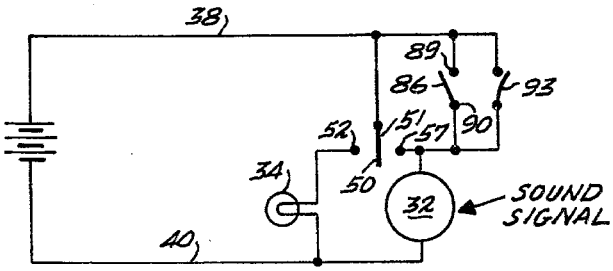
FIG. 3 is a wiring diagram of the electrical system.

Referring to the drawings wherein like reference characters designate like or corresponding parts throughout the several views, there is shown in FIGS. 1 and 2 a housing 12 having a compartment therein generally designated by the numeral 14 and, preferably, having a string or loop 16 connected at the ends 18 and 20 to the housing, so that the housing may be hung on a door knob. Within the housing, there is a septum 22 defining the two compartments 24 and 26. Within the compartment there are three batteries 28, 29 and 30 electrically connected in series with one another in the conventional manner illustrated so as to energize a sound making device 32 or, alternatively, a bulb 34 in a socket 36 connected by conductors 38 and 40 to the batteries and the sound signal 32 is connected to the batteries by the conductors 41 and 42. In the preferred embodiment the sound making device is provided with a screw-threaded adjustment means 45 accessible through an opening in the housing for adjustment purposes. Exteriorly carried on the housing there is a switch 50 which, as will be explained with reference to the circuit drawing hereinafter, is of the double-throw type which is normally in a neutral position. Referring now to the circuit diagram, the switch generally designated by the numeral 50 is provided with a terminal 52 in series with the light bulb socket 36 for the light bulb 34 and with the main conductor from the batteries 38 and 40. Thus, when the switch 50 is in the position such that the arm is moved into engagement with the terminal 52, the light bulb will be energized. Optionally, the switch may be moved from the neutral position 51 to the terminal 57 and, in this event, energy from the batteries flows through the sound producing signal 32 causing a sound. It is thus seen that the device is adapted to be carried and utilized as a flashlight or, optionally, as an alarm device so that if a person feels threatened, he may turn on the sound signal to cause a loud noice to scare off the person who he believes is about to attack him.

The device may also be utilized in a hotel room. To this end, there is an attachment generally designated by the numeral 70 which is composed of a pair of parallel conductors in the cable 72 which has a terminal end with the leads 74 and 76 in jack form as shown on the end 78 and, additionally, on the other end 80 a pair of bifurcated spring-biased members 82 and 84 shown in their normal bifurcated position with a safety switch 86 pivotal on the pivot means 88 into closing relation of lead terminals 89 and 90. In use, when the attachment 70 is utilized by plugging the jack end 78 into the plug opening 81, the aforesaid switch 50 for causing the light or alarm to go on by manual operation, is by-passed, electrically speaking, and, when the terminal ends 89 and 90 are in electrical engagement with one another, the sound making alarm will sound. For this purpose, in use, the two bifurcated ends 82 and 84 are pressed together as indicated by arrow 92, causing a space between the electrical terminals 89 and 90 with the member 86 rotated into and out of the way position and, the ends 82 and 84 are captivated between a closed door and a jamb. When the door is opened, the device will fall to the floor and the contacts 89 and 90 will close upon one another permitting current to flow to the audio signal. As an optional device in the attachment 70, a metal unit of switch form 93 may be inserted by means of the conductors 94 and 95 comprising leads connecting across the conductors within the cable 72 so that, when the switch 93 is closed, current will flow through the attachment closing the circuit and setting off the sound making device. There are numerous types of metallic switches such as the bimetal plate designated by the numeral 93 which are commercially available which are set to go off at a predetermined temperature, in this case, 135° F. regarded by numerous authorities as the danger point for fire. When this device is installed in a suitable location and the heat goes up to a predetermined level, the switch will close and the alarm will sound.

In a final alternative embodiment, in lieu of the attachment designated by the numeral 70, an attachment may be provided which will be connected the same as the attachment 70 and hence, is shown in schematic diagram form to be composed of a mercury switch with a lead 101 and 103 and a bulb of mercury 105. When in a briefcase, and the briefcase 107 is moved, the mercury will flow to complete a circuit between the leads 101, 103 setting off the alarm within the briefcase.

Figure 5:
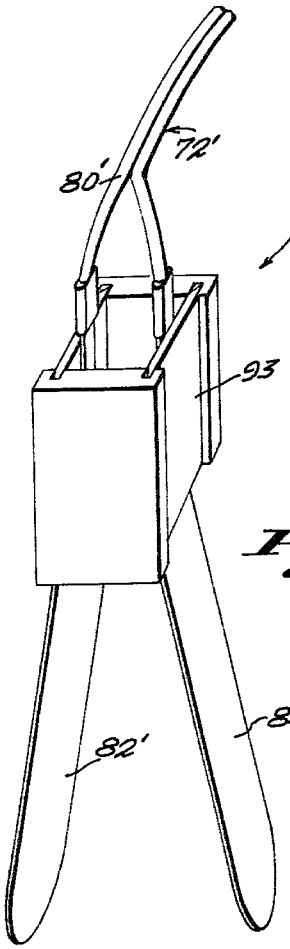
FIG. 5 is an alternative embodiment of the invention.
Figure 6:
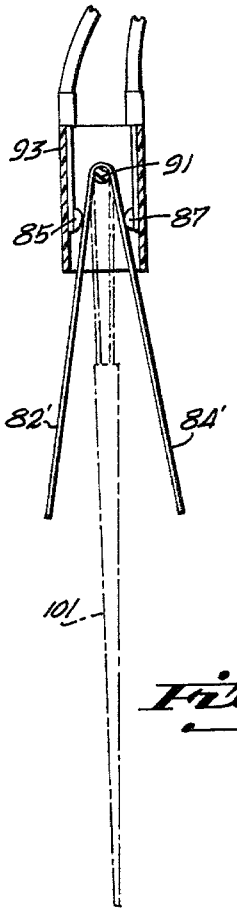
FIG. 6 is a view in cross section of FIG. 5.
Figure 7:
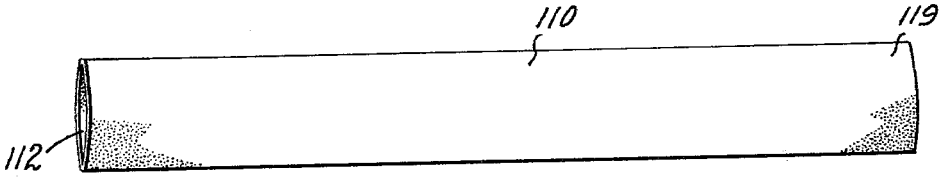
FIG. 7 is a perspective view of a sock to be used with the embodiment of FIG. 5 or of equivalent part of FIG. 2.
Figure 8:
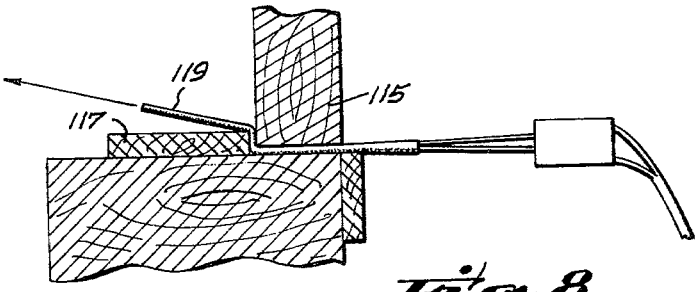
FIG. 8 is an illustration of the sock of FIG. 7 in use.

FIGS. 5 and 6 show an alternative attachment 70' composed of a pair of parallel conductors in the cable 72' and on the terminal end 80' a pair of bifurcated spring steel legs 82' and 84' of a single piece of spring steel pivotal in open and closed relation, on pin 91 in the housing 93, contrast FIG. 6 and FIG. 8. When the legs are together as in the dotted line position of FIG. 6 they do not engage the conductor terminals 85 and 87. A thin flexible film sock 101 such as one of plastic is provided which has an open mouth 112 and is sized to hold the legs together when inserted with it. When leaving a room, the sock and legs can be inserted between a door edge 115 and jamb 117 as the door is closed; and, then, the free end 119 is pulled from it. This protects a room when the occupant is not in it. When in it, the occupant merely inserts the legs between the door and jamb.

What is claimed is:

1. A portable alarm device including:

a housing, a horn to create a sound signal; battery means; said battery means and said horn being carried in said housing, first circuit means electrically interconnecting said horn and said battery, said first circuit means including a normally closed first switch means adapted for activating and energizing the horn, said housing being portable and sized to nest within a user's hand, an electric light bulb in said housing, said housing having a light port and including means to hold the bulb out the light port for option use of the device as a flashlight, and second circuit means in the housing including said bulb and said second circuit means being in parallel with (a) said horn and (b) said normally closed first switch means, second switch means in the housing including a movable switch arm and a first and a second terminal and an intermediate neutral station, said first terminal being electrically between said first switch means and said horn and said second terminal being between electrically in series with said electric light bulb and said arm being movable through said neutral station for selectively energizing either (a) the light bulb, (b) the audio device or (c) to remain in the neutral station;

said first switch means comprising a flexible bendable conductor means having a jack means at one end, a receptacle in the housing sized to receive said jack for connecting said first switch means electrically in said series with said audio signal and said first switch means including a body, a first portion, a second portion, and resilient means normally urging said first switch means into a switch closed position and said resilient means being yieldably adapted to be inserted between a door and a door jamb to open said first switch means, so that when said switch portions are in close adjacent relation and between a door and a door jamb the first switch means is open but, when the door is opened, the switch, which will close automatically under the influence of said resilient means causing a sound signal from said horn, and hanging means on said housing for attachment of the device to a door knob.

2. The device as set forth in claim 1 wherein said attachment includes a third switch means in parallel with said second switch means, said third switch means comprising a normally open switch composed of a heat-deformable element yieldable in response to heat to close the circuit and cause energy to flow from the battery to the audio signal.

* * * * *